United States Patent [19]

Ryser et al.

[11] 4,143,574

[45] Mar. 13, 1979

[54] STAMPING DEVICE FOR A FINEBLANKING PRESS

[75] Inventors: Urs Ryser; Istvan Meszaros; Rudolf Graf; Hans Reusser, all of Murten, Switzerland

[73] Assignee: Fribosa Ltd., Murten, Switzerland

[21] Appl. No.: 848,876

[22] Filed: Nov. 7, 1977

Related U.S. Application Data

[63] Continuation of Ser. No. 709,791, Jul. 30, 1976, abandoned.

[30] Foreign Application Priority Data

Dec. 15, 1975 [DE] Fed. Rep. of Germany ..... 2556466

[51] Int. Cl.[2] ..... B26D 1/00

[52] U.S. Cl. ..... 83/698; 72/336

[58] Field of Search ..... 83/563, 698; 72/328, 72/336

[56] References Cited

U.S. PATENT DOCUMENTS

| | | | |
|---|---|---|---|
| 2,009,660 | 7/1935 | Irmis | 83/698 |
| 2,899,922 | 8/1959 | Wheeler | 72/336 |
| 2,985,128 | 5/1961 | Henrickson | 72/328 |
| 3,125,917 | 3/1964 | Smeets | 83/698 |
| 3,252,315 | 5/1966 | Muench | 72/328 |
| 3,274,818 | 9/1966 | Henrickson | 72/336 |
| 3,537,291 | 11/1970 | Hawkins | 72/345 |
| 3,610,021 | 10/1971 | Hopper | 83/698 |
| 3,673,908 | 7/1972 | Smith | 83/685 |
| 3,848,494 | 11/1974 | Gargrave et al. | 83/698 |

*Primary Examiner*—Lowell A. Larson

*Attorney, Agent, or Firm*—Amster, Rothstein & Engelberg

[57] ABSTRACT

A fineblanking press having two groups of elements, the first group including an interchangeable die set having an upper die member, a lower die member and guide posts with the second group including a support plate, guide pins and an ejector element, the separate groups providing improved interchangeability, maintenance and stability.

3 Claims, 9 Drawing Figures

STAMPING DEVICE FOR A FINEBLANKING PRESS

This is a continuation, of application Ser. No. 709,791 filed July 30, 1976, now abandoned.

This invention relates to a stamping device for a fineblanking press and is particularly concerned with an upper retaining member and a lower retaining member which are connected with guide pins and a pressure plate.

Fineblanking produces precise finished parts in one single operation with cleanly sheared outer and inner contours over the whole of the material thickness. This is in comparison to conventionally stamped parts which generally show a cleanly sheared surface for one-third of the material thickness while the remaining two-thirds constitutes a fracture zone. From this comparison of the technique it follows that the design of a fineblanking press is very different from that of a conventional stamping press.

The requirements for fineblanking are that the press supply three pressures or forces. These are:

(1) Shear pressure (2) Clamping pressure (3) Counter pressure.

The material to be sheared is clamped outside the shear periphery with a pressure plate that normally carries an annular ring, and the material is clamped inside the shear periphery by means of an ejector. Shearing of the material occurs by pressure and counter pressure bearing on the material.

An important economic factor related to the fineblanking press is the change-over time required for the tooling. The retention of the tooling is another important factor and influences the quality of sheared surfaces obtained.

The device of the present invention, a stamping device used in conjunction with a fineblanking press, shows a simplified design in comparison to normal fineblanking devices, improves the change-over and setting-up time of tools and provides a better means of retaining the units as well as an overall more stable construction.

The fineblanking device of the present invention is seen as a device which consists of two groups of elements. The first group consists of an interchangeable die set with an upper member and a lower member connected through four guide posts. The second group on the punching side consists of a positionable support plate which also contains four guide pins for a guide plate, an ejector plate, a punch and location pins. The die plate side contains a fixed die plate, a support plate fastened to the die plate, an innerform punch and an ejector. Both groups form separate units, and the interchangeable die set and the tool guide posts are located within the interchangeable tool members.

It is an object of the invention to provide a stamping device for a fineblanking press having ease of interchangeability for the cutting elements.

It is another object of the invention to provide a stamping device for a fineblanking press having an improved stable location of the guide plate.

It is a further object of the invention to provide a stamping device with improved change-over and setting-up time features.

These and other objects will be apparent from the following description when read in connection with the drawings, in which.

Figure 1:
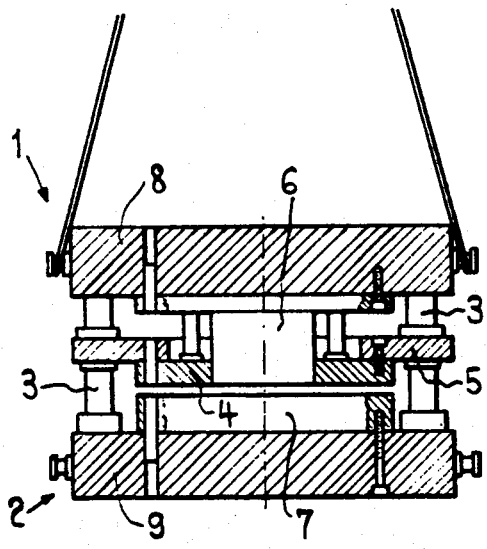
FIG. 1 is a simplified view in section of a conventional prior art fineblanking press.

In FIG. 1 showing a simplified view of a prior art conventional fineblanking press the upper die member 1, the lower die member 2, and the guide posts 3 are shown. The upper die member 1 is guided through an upper die shoe 8, and the lower die member 2 is guided through a lower die shoe 9. Between the upper and lower die shoes there is located a pressure plate 4, and a pressure plate retainer 5. This retainer plate is guided through die posts 3 which are four in number. On the upper die shoe 8 a shearing punch 6 is located while its opposing member, a die plate 7, is located on the lower die shoe 9. The method of retention of these members with various screws is not shown here in detail.

It is clearly visible from FIG. 1 that the three main members, upper and lower die shoes 8, 9 as well as pressure plate retainer 5 are all guided by guide posts 3, and that the interchange of tool components, especially in assembly, can cause great problems. Also the pressure retainer plates, which guide the main punch, are guided at their extremities and necessitates extreme requirements to provide precision and stability of the retention system.

Figure 2:
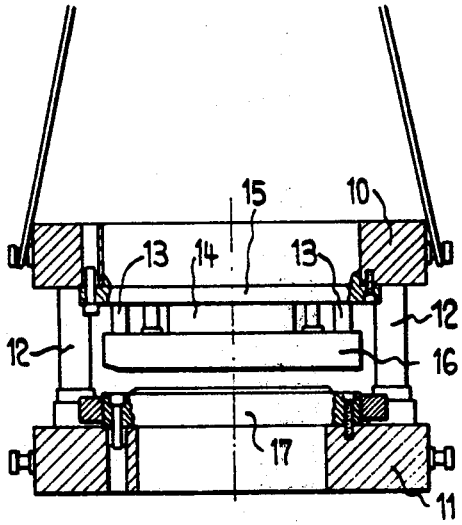
FIGS. 2, 3 and 4 are views similar to FIG. 1 showing the fineblanking press of the present invention and particularly illustrating the disassembly feature in the different views.
Figure 3:
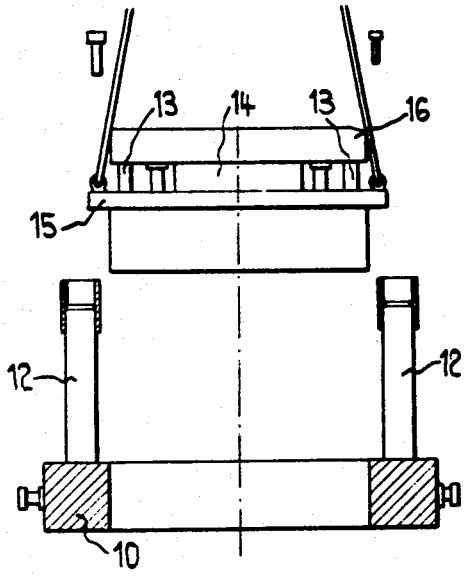
Figure 4:
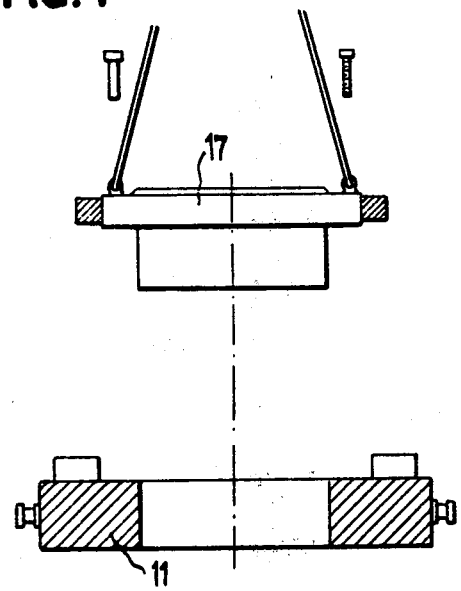

In FIGS. 2–4 it can be seen that the fineblanking press of the subject invention is divided into two units that can be considered to be completely separate. The first unit consists of the interchangeable die set including the upper die shoe 10, the lower die shoe 11 as well as the guide posts 12. The second unit relates to the punch side and includes tool guide pins 13, a punch 14, a support plate 15 and an integrated pressure plate 16 which will henceforth be called the guide plate. The guide plate 16 is guided in sleeves so that all these components form a separate group completely separated from the die shoes. There is also provided a die plate 17 which is separate from the die shoe unit.

From FIGS. 2–4 it can be seen that interchangeability and assembly of tooling is vastly simplified in comparison to the prior art shown in FIG. 1. First of all, it is clear that guide plate 16 is no longer guided over and by the die posts as shown in the prior art. Further, an important advantage is that the cutting elements of the tooling can be ground and adjusted completely independently of the die shoes, and this simplifies tool maintenance.

FIG. 3 shows that after the upper and lower die shoes have been separated, upper die shoe 10 can be turned over, and the punch side unit can be completely removed. FIG. 4 shows the removal of the die side unit from the lower die shoe.

A further advantage of the present invention is that when several tools of approximately the same size are to be built, only one interchangeable die set (the first unit) and per tool only two groups interchangeable cutting elements (the second unit) will be required. These can easily be built or interchanged in the basic die shoes. With each set of tooling elements a die set can thus be saved.

The third major advantage of the stamping device of the fineblanking press relates to the location of die posts 13 which provides a more stable location of guide plate 16 because the moment of force as compared to the prior art of FIG. 1 is greatly reduced.

There follows a detailed description of the novel stamping device whereby for this purpose unnecessary elements are not shown or described. This in order not to make the description too complicated, and only elements necessary for an understanding of the invention appear in the drawings.

Figure 5:
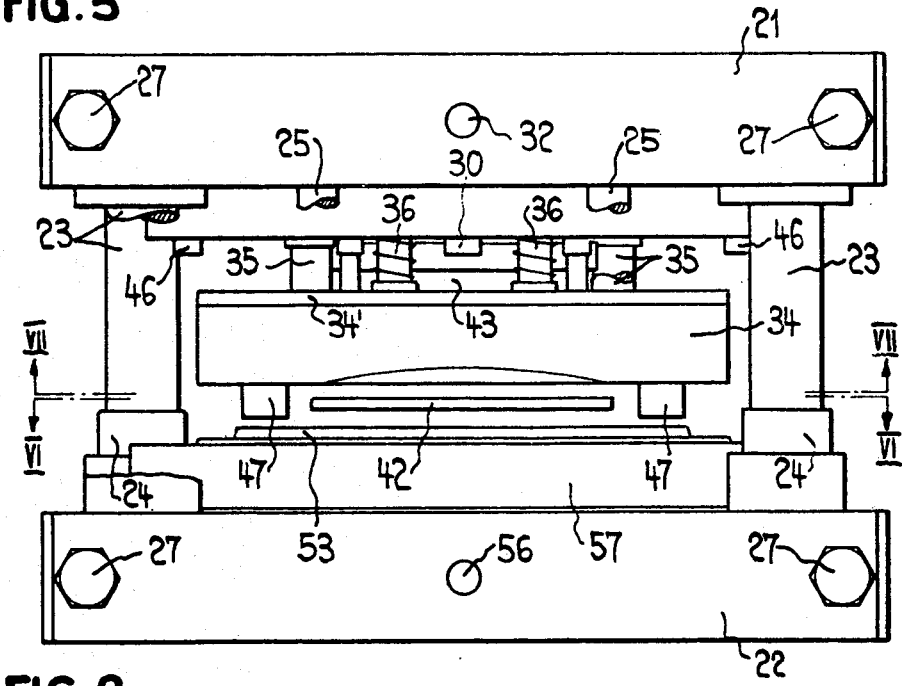
FIG. 5 is a front view of the fineblanking press of the present invention.

From FIG. 5, which shows approximately the same view as FIGS. 1 and 2, the first unit (the die set) is seen to consist of an upper die shoe 21, a lower die shoe 22 and the guide posts 23. The die posts are mounted in four ball bearing bushings respectively as indicated by numeral 24. On the upper die shoe material guides 26 are clamped with retainers 25 (see FIG. 8). The material guides are adjustable both vertically and horizontally, and it is to be noted that the complete device can be transported and handled by means of projecting bolts 27. Further, locating bores 28 and 29 for the units as shown in FIG. 8 are flame hardened to reduce wear and to provide greater safety.

Figure 8:
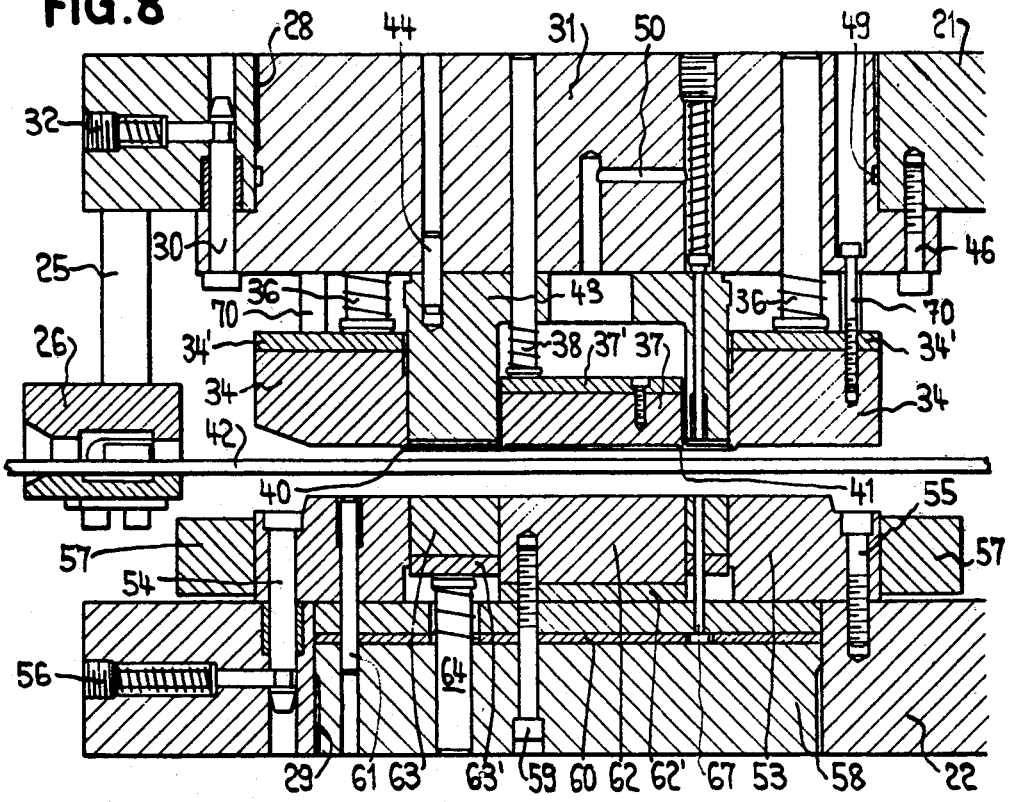
FIG. 8 is a sectional view taken along section line VIII—VIII in FIG. 6 and in FIG. 7.
Figure 9:
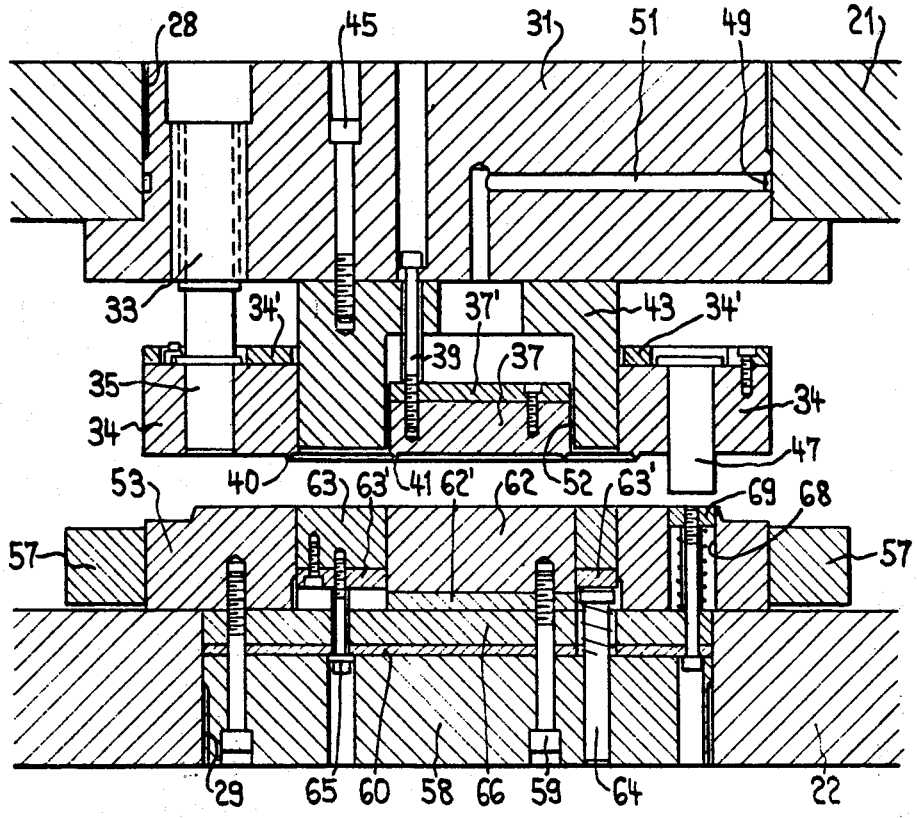
FIG. 9 is a sectional view taken along sectional line IX—IX in FIG. 6 and in FIG. 7.

The second unit contains on the punch side (shown above in the drawings) a die support plate 31 which is positioned by means of two precision locator pins 30 which are retained through retainer pins 32 (FIG. 8). In support plate 31 are four ball bearing sleeves indicated by 33 (FIG. 9). These locate and guide punch posts 35 which, in turn, guide pressure plate 34. Pressure or guide plate 34 is actuated by pressure pins 36 and retained through screws 70 (FIG. 8).

A movable ejector plate 37 is actuated through ejector pressure pins 38 and the ejector is retained by a screw as shown in FIG. 9. Both guide plate 34 and ejector plate 37 carry a vee-ring, 40 and 41 respectively, which retain the material 42 during the shearing operation. Depending on the hardness and thickness of the material, the vee-ring on the guide plate or the ejector plate may be eliminated. A punch 43 is spaced and located accurately from a dowel pin 44 and retained by means of screws 45 as shown in FIG. 9. Support plate 31 is hardened and is fixed to the upper die shoe through screws 46.

For the precise action of the stamping device locator pins 47 shown in FIG. 9 are very important. These insure alignment of the units and help lateral movement of the die members.

Simplify the tool maintenance it is practical to include spacer plates under guide plate 34 and ejector plate 37. A set of various thicknesses is available so that when one component is reground, for example the ejector plate, the remaining members, such as the guide plate and especially the pressure pins, do not have to be reground.

Figure 7:
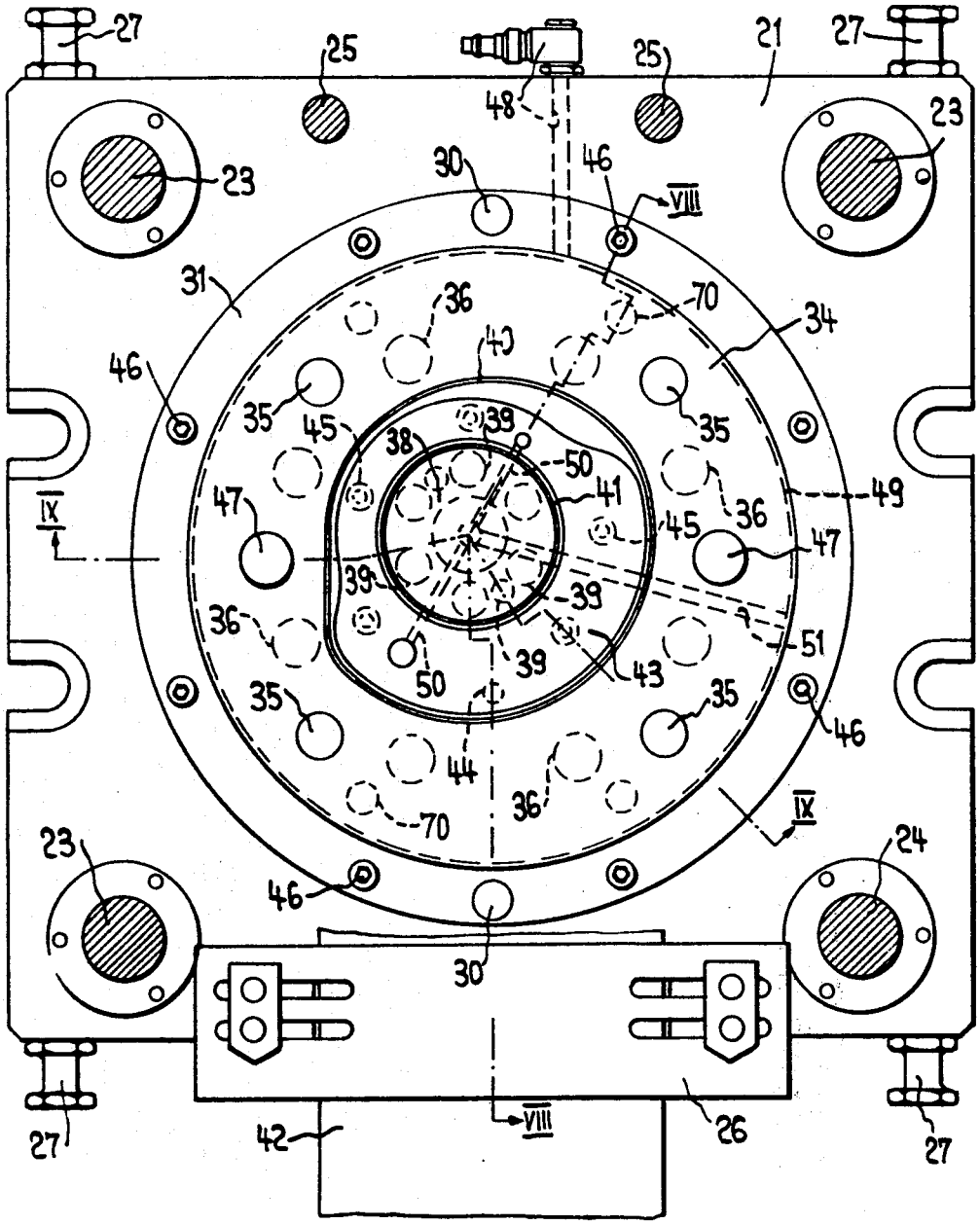
FIG. 7 is a sectional view taken along section line VII—VII in FIG. 5.

Proper functioning of the device is improved through cooling critical shearing edges. As shown in FIG. 7 this can be obtained through an air line with an inlet 48 connected to a slot 49 from where the compressed air reaches various positions, especially through lines 50 (FIG. 8) and 51 (FIG. 9) to the inner shearing areas where a ring 52 (FIG. 9) provides for the air flow.

It is to be appreciated that the entire punch side unit forms a member completely separate from the die set unit. On the die plate side shown below in the drawings there is a fixed die plate 53 which is located by means of dowel pins 54 and clamped to die shoe 22 through screws 55. These dowel pins are retained by means of retainer pins 56. Around die plate 53 is a shrink ring 57 which is hardened and serves to prevent or reduce movement or "breathing" of the die plate during the shearing operation, and thus insure cleanly sheared parts.

A punch support plate 58 is fastened to the die plate by means of screws 59. Between these two members is a spacer plate 60. Punch support plate 58 is positioned with dowel pins 61. An innerform punch 62 is mounted on punch support plate 58. An ejector 63 is operated by means of pressure pins 64, and ejector 63 is mounted on punch retainer plate 66 by retaining screws 65 (FIG. 9). In punch retainer plate 66 is a piercing punch 67 which passes through ejector 63. Die plate 53 has an aperture 68 on each side in which is located a spring-loaded cover plate 69. When locator pins 47 enter die plate apertures 68, these cover plates 69 are depressed. Also die support plate 31 may carry a vee-ring. Further, innerform punch 62 and ejector 63 include spacer plates with the same purpose as already described above.

The remaining elements of the fineblanking device are not part of the invention and need not be described as they operate in the normally known function of fineblanking presses. The operation of the press disclosed herein is the same as the prior art. Upper die shoe 21 guides the material through the die, the die closes, and the guide plate 34 as described above clamps the material against the die plate face. The counter pressure clamps the material onto the face of the punch.

Figure 6:
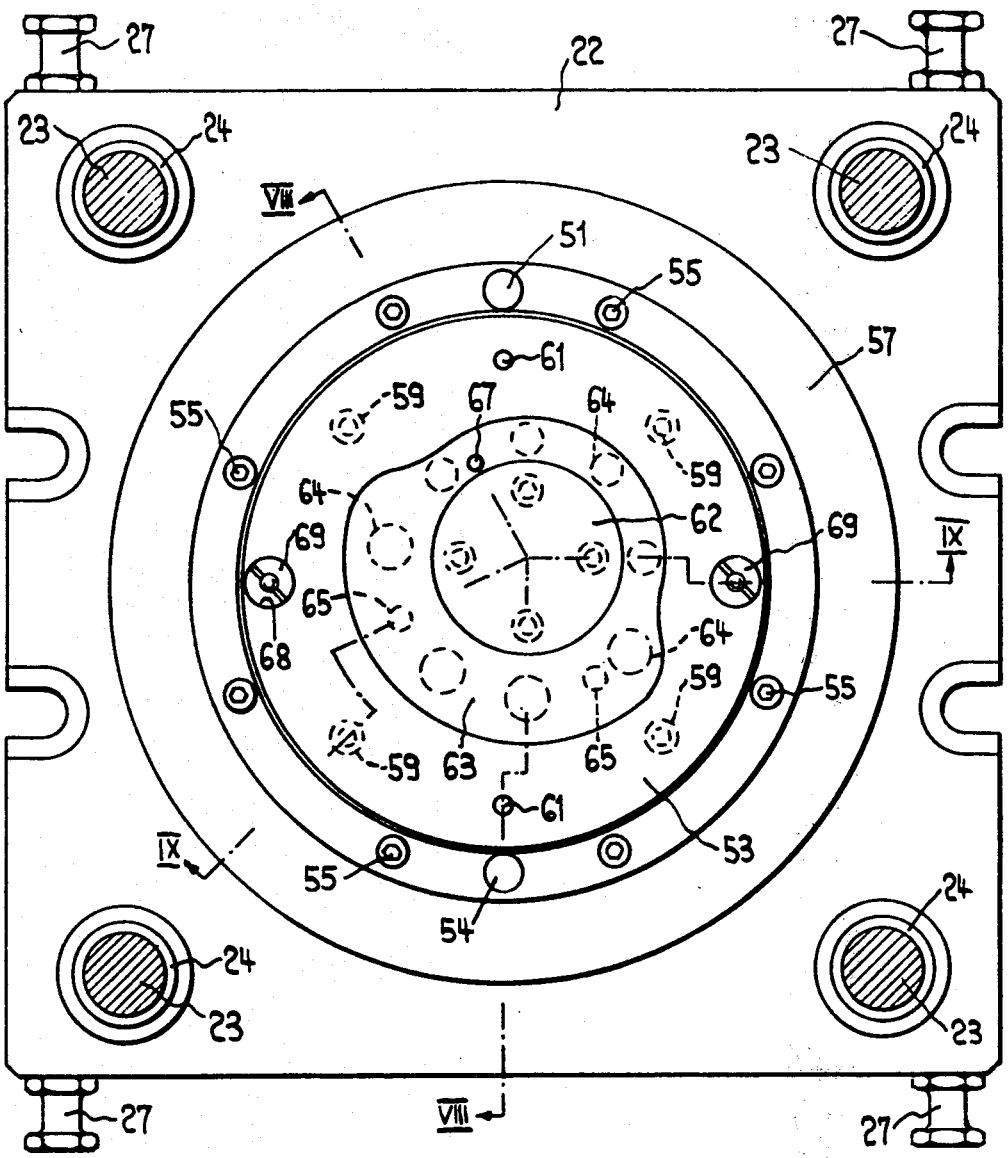
FIG. 6 is a sectional view taken along section line VI—VI of FIG. 5.

During the shearing operation the upper press table (not shown) remains at a fixed point and the upper and lower clamping pressures remain constant. The die opens, and the material is stripped from the main punch. As the material begins to feed, the sheared part is ejected from the die plate through the ejector, and the part is cleared from the die area. As an example of a fineblanked part, a cam has been shown (see FIGS. 6 and 7).

From the above description the most important features of the system have been explained. The moment of force from the guide (pressure) plate to the die set posts is far less with the device of the invention than on conventional fineblanking presses. Also, the guide plate is actually guided and therefore contributes to a far greater degree to the correct function of the system.

It is seen most clearly from FIGS. 2, 3 and 4 that on the one hand a precise location of all members is obtained, and secondly, that the interchangeability of similar types of cutting elements can be made far more easily with this device than with the conventional type dies. Also, all maintenance procedures are simplified. Greater stability is obtained with the solid-hardened support plates beneath the punch and die plate as well as the innerform punch, which is of prime importance particularly on large dies. As fineblanking dies work under high specific pressure loading, a "settling" of the punch into the support plate is a well known problem. Using the hardened steel support plate practically eliminates this problem under the punches.

In describing the fineblanking device of the invention, the terminology "upper" and "lower" has been used. This is to relate to the schematic views shown, but the device, and the press, may also function in a horizontal position.

Of course, in relation to the overall aspects of the invention, certain members may be located differently than shown on the example drawings. There may be various numbers and types of piercing punches, and the position and method of retention may be different. It is, however, important that the guide plate is integrated in the punch side unit and that the guide posts for the pressure plate are guided in the support plate, that is, within the cartridge die unit with the use of friction fit sleeves if required.

As will be readily apparent to those skilled in the art, the invention described may be used in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalence of the claims are therefore intended to be embraced therein.

What we claim is:

1. A device for a fineblanking press comprising a first unit and a plurality of interchangeable second units, each said second unit individually cooperable with said first unit;

said first unit comprising an upper shoe member, a lower shoe member, a plurality of outer guide posts interconnecting said shoe members, a lower punch support plate mounted on said lower shoe and including an interform punch to exert upward pressure on a workpiece;

each said second unit comprising an upper support plate including spacedly located vertically mounted sleeve members extending therethrough radially inward of said outer guide posts, a punch mounted in fixed relation with said upper support plate to provide shear pressure on the workpiece, a plurality of vertically mounted inner tool guide posts spacedly located in said upper support plate respectively corresponding to said sleeve member locations, each said guide post having an upper part and a lower part, each said upper part extending through said upper support plate to be slidingly mounted within each said respective sleeve member, and a guide pressure plate surrounding said punch and exerting downward pressure on the workpiece against the upward pressure of said lower punch support plate and interform punch, each said guide post lower part mounted to extend through said pressure plate to provide guided movement therefor without deviation; and said upper support plate operably connected to said upper shoe member and detachable therefrom to provide withdrawal separation of each said second unit from said first unit for interchanging with another said second unit.

2. A device according to claim 1 wherein a die plate is mounted on said lower shoe member and detachable therefrom for withdrawal removal from said first unit.

3. A device according to claim 1 wherein a plurality of locator pins are mounted in said upper support plate, and said support plate is positioned by means of said locator pins.

* * * * *